US010985515B2

(12) United States Patent
Tanaka et al.

(10) Patent No.: US 10,985,515 B2
(45) Date of Patent: Apr. 20, 2021

(54) SURFACE MOUNT CONNECTOR AND SURFACE MOUNT CONNECTOR SET

(71) Applicant: Murata Manufacturing Co., Ltd., Kyoto-fu (JP)

(72) Inventors: Aoi Tanaka, Nagaokakyo (JP); Daisuke Okada, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 17/065,326

(22) Filed: Oct. 7, 2020

(65) Prior Publication Data

US 2021/0021090 A1 Jan. 21, 2021

Related U.S. Application Data

(63) Continuation of application No. 16/994,469, filed on Aug. 14, 2020.

(Continued)

(30) Foreign Application Priority Data

Aug. 10, 2018 (JP) ..... JP2018-151711

(51) Int. Cl.
*H01R 24/50* (2011.01)
*H01R 24/44* (2011.01)
*H01R 12/57* (2011.01)

(52) U.S. Cl.
CPC ..... *H01R 24/50* (2013.01); *H01R 12/57* (2013.01); *H01R 24/44* (2013.01)

(58) Field of Classification Search
CPC ..... H01R 12/57; H01R 24/44; H01R 24/50

(Continued)

(56) References Cited

U.S. PATENT DOCUMENTS 4,294,004 A * 10/1981 Frank ..... H01H 9/12 174/51
5,466,160 A * 11/1995 Ogura ..... H01R 24/50 333/260

(Continued)

FOREIGN PATENT DOCUMENTS

CN 206432447 U 8/2017
JP 2006-156118 A 6/2006

(Continued)

OTHER PUBLICATIONS

International Search Report issued in PCT/JP2019/029518; dated Oct. 8, 2019.

(Continued)

*Primary Examiner* — Abdullah A Riyami
*Assistant Examiner* — Vladimir Imas
(74) *Attorney, Agent, or Firm* — Studebaker & Brackett PC

(57) ABSTRACT

A surface mount connector in which an internal terminal does not extend to a location outside an external terminal is provided. A surface mount connector includes an external terminal that includes a tubular portion that extends in a first direction, an internal terminal that is separated from the external terminal inside the tubular portion when viewed in the first direction, and an insulator that is disposed between the internal terminal and the external terminal and that has a first main surface and a second main surface opposite the first main surface. The insulator inside the tubular portion has a through-hole that extends from the first main surface to the second main surface.

9 Claims, 9 Drawing Sheets

Related U.S. Application Data

(60) Provisional application No. PCT/JP2019/029518, filed on Jul. 26, 2019.

(58) Field of Classification Search
USPC ..... 439/63
See application file for complete search history.

(56) References Cited

U.S. PATENT DOCUMENTS 5,653,601 A * 8/1997 Martucci ..... H01R 4/028 439/82
5,662,480 A * 9/1997 Togashi ..... H01R 24/50 439/582
5,871,371 A * 2/1999 Rothenberger ..... H01R 9/038 439/579
6,712,645 B1 * 3/2004 Chou ..... H01R 9/0518 439/582
7,008,235 B2 * 3/2006 Watanabe ..... H01R 24/50 439/581
7,114,957 B2 * 10/2006 Duquerroy ..... H01R 9/0515 439/63
7,632,123 B2 * 12/2009 Nakagawa ..... H01R 24/46 439/188
8,262,398 B2 * 9/2012 Chen ..... H01R 24/50 439/188
8,419,463 B2 * 4/2013 Taguchi ..... H01R 13/504 439/449
8,876,552 B2 * 11/2014 Taguchi ..... H01R 13/501 439/582
8,920,181 B2 * 12/2014 Hida ..... H01R 24/46 439/188
8,944,827 B2 * 2/2015 Ohsaka ..... H01R 12/57 439/63
9,203,196 B2 * 12/2015 Hirakawa ..... H01R 24/50
9,236,668 B2 * 1/2016 Yeh ..... H01R 4/5083
9,509,106 B2 * 11/2016 Nakamura ..... H01R 24/50
9,935,382 B2 * 4/2018 Okura ..... F21K 9/23
10,158,200 B2 * 12/2018 Miyazaki ..... H01R 13/20
10,283,905 B2 * 5/2019 Regnier ..... H01R 13/6277
2006/0024985 A1 * 2/2006 Nagata ..... H01R 13/6315 439/63
2008/0038940 A1 * 2/2008 Chen ..... H01R 9/0518 439/63
2009/0149063 A1 * 6/2009 Yotsutani ..... H01R 12/718 439/578
2009/0298333 A1 * 12/2009 Yotsutani ..... H01R 12/718 439/581
2010/0227481 A1 * 9/2010 Liao ..... H01R 24/46 439/63
2012/0122339 A1 * 5/2012 Taguchi ..... H01R 13/504 439/578
2013/0244486 A1 * 9/2013 Ohsaka ..... H01R 12/57 439/581
2015/0155662 A1 * 6/2015 Lapidot ..... H01R 12/57 439/581
2017/0366716 A1 * 12/2017 Sigle ..... H04N 5/2257
2019/0052031 A1 * 2/2019 Takahashi ..... H01R 13/504

FOREIGN PATENT DOCUMENTS

JP 2011-40201 A 2/2011
JP 2013-098122 A 5/2013
JP 2013-191341 A 9/2013
WO 2011/013747 A1 2/2011
WO 2018/074227 A1 4/2018

OTHER PUBLICATIONS

Written Opinion issued in PCT/JP2019/029518; dated Oct. 8, 2019.
An Office Action mailed by Taiwan Intellectual Property Office dated May 26, 2020, which corresponds to Taiwanese Patent Application No. 108126928 and is related to U.S. Appl. No. 16/994,469.

* cited by examiner

SURFACE MOUNT CONNECTOR AND SURFACE MOUNT CONNECTOR SET

CROSS-REFERENCE TO RELATED APPLICATIONS

This application is a Continuation of U.S. patent application Ser. No. 16/994,469 filed Aug. 14, 2020, which claims benefit of priority to International Patent Application No. PCT/JP2019/029518, filed Jul. 26, 2019, and to Japanese Patent Application No. 2018-151711, filed Aug. 10, 2018, the entire contents of each are incorporated herein by reference.

BACKGROUND

Technical Field

The present disclosure relates to a surface mount connector and a surface mount connector set that can be mounted on a substrate.

Background Art

As for a surface mount coaxial connector, in order to inhibit an internal terminal from being out of position and to decrease a height, a known coaxial connector plug has a space such as a tunnel for extending the internal terminal through an external terminal to extend the internal terminal to a location outside the external terminal (cylindrical portion), as described, for example, in Japanese Unexamined Patent Application Publication No. 2013-98122.

SUMMARY

In the tunnel portion of the coaxial connector plug, a distance (gap) between an external conductor that corresponds to the external terminal and an external terminal of a central conductor that corresponds to the internal terminal may cause impedance mismatching, which results in degradation in characteristics. To avoid this, a product height increases.

Since the internal terminal extends to the location outside the external terminal (cylindrical portion), this is a factor in an electric field disturbance, a propagation mode changes by degrees at a higher frequency, and there is a possibility that a decrease in a cutoff frequency makes transmission impossible.

Accordingly, the present disclosure provides a surface mount connector in which an internal terminal does not extend to a location outside an external terminal.

A surface mount connector according to the present disclosure includes an external terminal that includes a tubular portion that extends in a first direction, an internal terminal that is separated from the external terminal inside the tubular portion when viewed in the first direction, and an insulator that is disposed between the internal terminal and the external terminal and that has a first main surface and a second main surface opposite the first main surface. The insulator inside the tubular portion has a through-hole that extends from the first main surface to the second main surface.

A surface mount connector according to the present disclosure, in which an internal terminal does not extend to a location outside an external terminal, removes a factor in an electric field disturbance, removes a factor in a change in a propagation mode, and inhibits a cutoff frequency from decreasing. In addition, adjustment in the size of a through-hole that is formed inside the external terminal enables the characteristics impedance of the external terminal and the internal terminal to be adjusted and enables electrical characteristics to be improved.

DETAILED DESCRIPTION

Figure 1A:
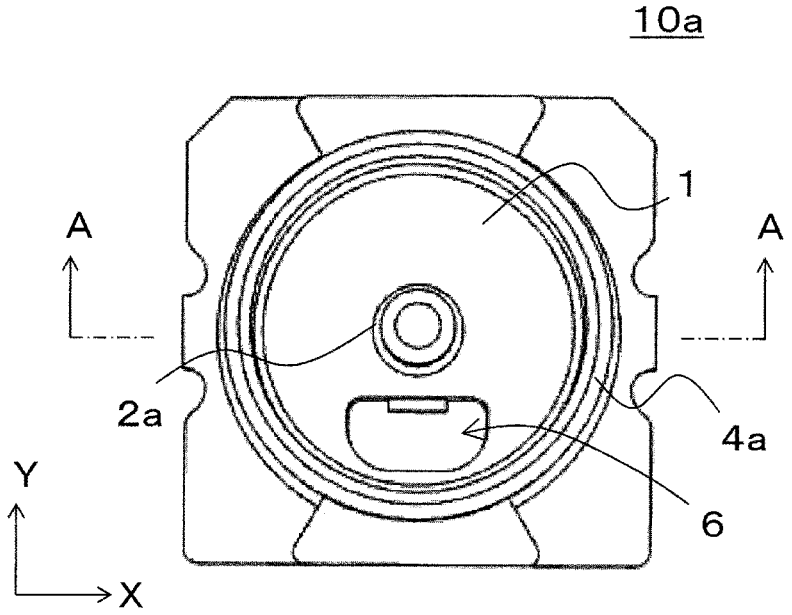
FIG. 1A is a plan view of a surface mount connector according to a first embodiment.

A surface mount connector according to a first aspect includes an external terminal that includes a tubular portion that extends in a first direction, an internal terminal that is separated from the external terminal inside the tubular portion when viewed in the first direction, and an insulator that is disposed between the internal terminal and the external terminal and that has a first main surface and a second main surface opposite the first main surface. The insulator inside the tubular portion has a through-hole that extends from the first main surface to the second main surface.

In a surface mount connector according to a second aspect, an entire circumference of the through-hole may be surrounded by the insulator when viewed in the first direction in the above first aspect.

In a surface mount connector according to a third aspect, the insulator may have a plurality of the through-holes inside the tubular portion in the above first or second aspect.

In a surface mount connector according to a fourth aspect, the insulator may have a groove that is on the second main surface and that extends from the through-hole to a location outside the tubular portion when viewed in the first direction in any one of the above first to third aspects.

In a surface mount connector according to a fifth aspect, the groove may extend from the first main surface to the second main surface in the above fourth aspect.

A surface mount connector set according to a sixth aspect includes a first surface mount connector that includes a first external terminal and a first internal terminal, and a second surface mount connector that includes a second external terminal that engages the first external terminal and a second internal terminal that engages the first internal terminal. The first surface mount connector includes the first external terminal that includes a tubular portion that extends in a first direction, the first internal terminal that is separated from the first external terminal inside the tubular portion when viewed in the first direction, and a first insulator that is disposed between the first internal terminal and the first external terminal and that has a first main surface and a second main surface opposite the first main surface. The second surface mount connector includes the second external terminal that includes a tubular portion that extends in the first direction and that has a diameter larger than that of the first external terminal, the second internal terminal that is separated from the second external terminal inside the tubular portion when viewed in the first direction, and a second insulator that is disposed between the second internal terminal and the second external terminal and that has a first main surface and a second main surface opposite the first main surface. The first insulator or the second insulator inside the tubular portion, or each of the first and second insulators has a through-hole that extends from the first main surface to the second main surface.

In a surface mount connector set according to a seventh aspect, each of the first and second insulators inside the tubular portion may have the through-hole that extends from the first main surface to the second main surface in the above sixth aspect.

In a surface mount connector set according to an eighth aspect, the first insulator may have the through-hole, and an entire circumference of the through-hole is surrounded by the first insulator when viewed in the first direction in the above sixth aspect.

In a surface mount connector set according to a ninth aspect, the second insulator may have the through-hole, and an entire circumference of the through-hole is surrounded by the second insulator when viewed in the first direction in the above sixth aspect.

Surface mount connectors and surface mount connector sets according to embodiments will hereinafter be described with reference to the accompanying drawings. In the drawings, components substantially like to each other are designated by like reference characters, and a duplicated description is omitted.

First Embodiment

Figure 1B:
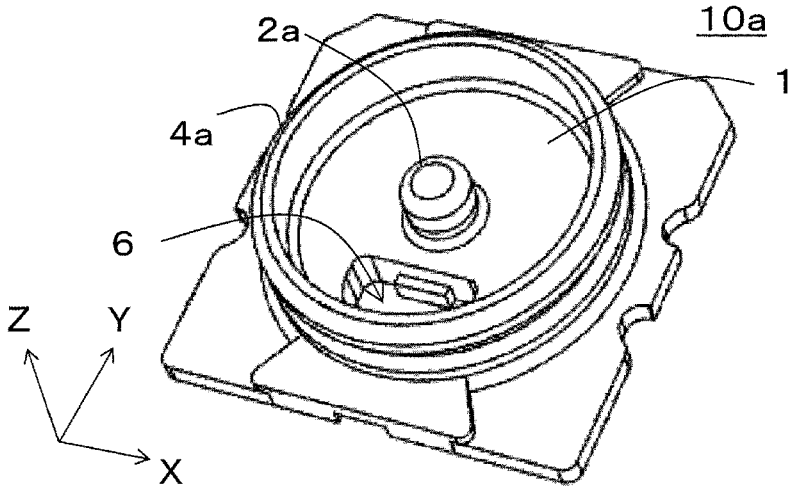
FIG. 1B is a perspective view of the surface mount connector according to the first embodiment.
Figure 1C:
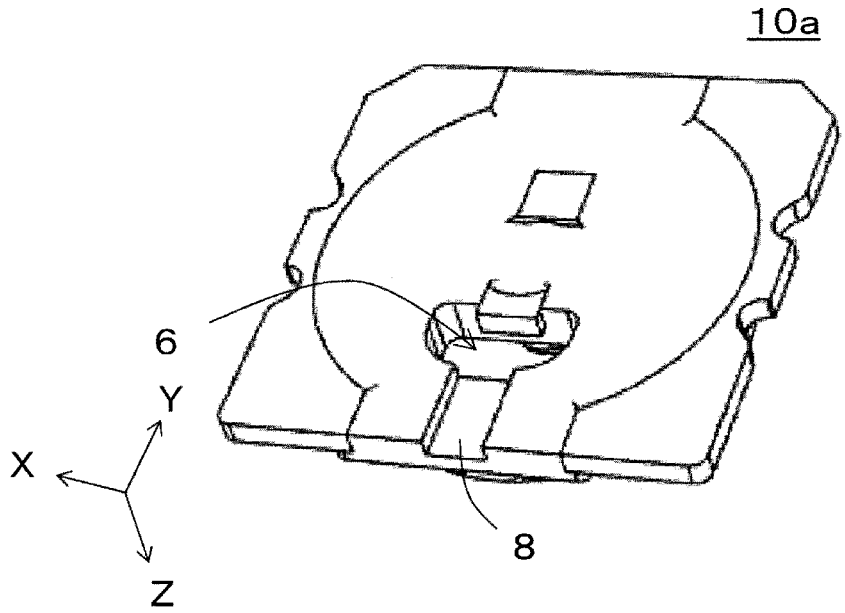
FIG. 1C is a perspective back view of the surface mount connector according to the first embodiment.
Figure 1D:
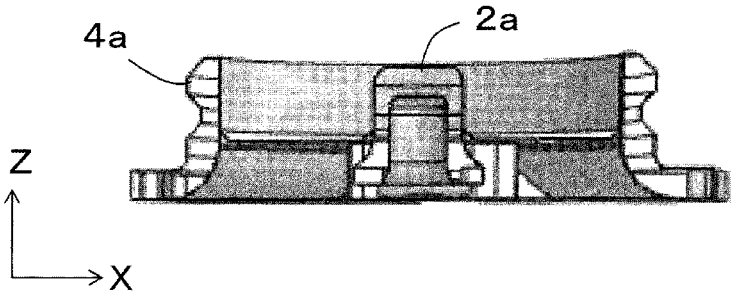
FIG. 1D is a sectional view of FIG. 1A taken along line A-A.

FIG. 1A is a plan view of a surface mount connector 10*a* according to a first embodiment. FIG. 1B is a perspective view of the surface mount connector 10*a* according to the first embodiment. FIG. 1C is a perspective back view of the surface mount connector 10*a* according to the first embodiment. FIG. 1D is a sectional view of FIG. 1A taken along line A-A. In the figures, for convenience, a direction in which a tubular portion of an external terminal 4*a* extends is referred to as a z-direction, and in-plane is referred to as an x-y plane.

The surface mount connector 10*a* is a receptacle (male type) and includes the external terminal 4*a*, an internal terminal 2*a*, and an insulator 1. The external terminal 4*a* includes the tubular portion that extends in a first direction (z-direction). The internal terminal 2*a* is separated from the external terminal 4*a* inside the tubular portion when viewed in the first direction. The insulator 1 is disposed between the internal terminal 2*a* and the external terminal 4*a* and has a first main surface and a second main surface opposite the first main surface. The insulator 1 inside the tubular portion has a through-hole 6 that extends from the first main surface to the second main surface.

The surface mount connector 10*a*, in which the internal terminal 2*a* does not extend to a location outside the external terminal 4*a*, removes a factor in an electric field disturbance, removes a factor in a change in a propagation mode from a TEM mode into a higher-order mode, and inhibits a cutoff frequency from decreasing. Adjustment in the size of the through-hole 6 that is formed inside the external terminal 4*a* enables characteristics impedance of the external terminal 4*a* and the internal terminal 2*a* to be adjusted and enables electrical characteristics to be improved. The through-hole 6, which is an air layer and has a relative dielectric constant of 1, inhibits a surrounding component such as the external terminal from being affected by electric fields close to each other unlike the case where a substance that has a relative dielectric constant of 1 or more is filled therein. For this reason, the cutoff frequency can be a frequency in a high frequency band, and a connector that supports an increased frequency can be provided. In the case where a space is formed as the through-hole 6, flux that comes from solder during mounting can be stored in the space, and the flux can be inhibited from rising. The surface mount connector is a receptacle but is not limited thereto. The surface mount connector may be a receptacle or a plug receptacle. The surface mount connector is a coaxial connector but is not limited thereto.

Components that are included in the surface mount connector 10*a* will now be described.

<Insulator>

The insulator 1 is composed of, for example, resin. Insulating resin that is typically used is used as the resin. For example, a LCP (Liquid Crystal Polymer) may be used. The insulator 1 is disposed between the internal terminal 2*a* and the external terminal 4*a* and has the first main surface and the second main surface. The insulator 1 is molded by, for example, insert molding. The insulator 1 ensures electrical insulation between the internal terminal 2*a* and the external terminal 4*a*.

The insulator 1 inside the tubular portion has the through-hole 6 that extends from the first main surface to the second main surface. For example, the through-hole 6 may be formed as a notch that is obtained by cutting a portion of the internal terminal 2*a* that extends toward a location outside the external terminal 4*a*. The through-hole 6 has a function of adjusting the characteristics impedance of the external terminal 4*a* and the internal terminal 2*a*. The through-hole 6 functions as the space in which the flux that comes from the solder during mounting onto a substrate is stored. The through-hole 6 and the external terminal 4*a* may not overlap when viewed in the first direction. In other words, the through-hole 6 is surrounded by the insulator 1 when viewed in the first direction. In this case, the flux can be inhibited from rising toward the external terminal 4*a*. An end portion of the internal terminal 2*a* may be exposed to the through-hole 6. This enables the end portion of the internal terminal 2*a* and the substrate to be checked in the first direction when being connected to each other and makes it easy to connect these. A groove 8 may be on the second main surface of the insulator 1 and extend from the through-hole 6 to a location outside the tubular portion of the external terminal 4*a*. In this case, the flux that comes from the solder during mounting can be stored also in the groove 8, and the flux can be inhibited from rising.

The through-hole 6 may be simultaneously formed during insert molding of the insulator 1, or the through-hole 6 may be formed by notching the insulator 1 after the insulator 1 is formed. The groove 8 may also be simultaneously formed during insert molding of the insulator 1, or the groove 8 may be formed by removing a part of the second main surface of the insulator 1.

<External Terminal>

The external terminal 4*a* includes the tubular portion that extends in the first direction (z-direction). In FIG. 1A to FIG. 1C, the tubular portion of the external terminal 4*a* has, but is not limited thereto, a circular shape and may have an elliptic shape, a rectangle shape, or a polygonal shape. The external terminal 4*a* may have any shape, provided that the external terminal 4*a* can be fitted to an external terminal that is to be connected thereto. The external terminal 4*a* is formed by using a plate composed of metal such as copper or a copper alloy. Plating such as Ni plating and Au plating may be performed on a surface.

<Internal Terminal>

The internal terminal 2*a* is separated from the external terminal 4*a* inside the tubular portion when viewed in the first direction (z-direction). In FIG. 1A and FIG. 1B, the internal terminal 2*a* has a pin shape such as a cylindrical shape but is not limited thereto. For example, as described according to a fifth embodiment later, a bend shape is also acceptable. The internal terminal 2*a* may have any shape, provided that the internal terminal 2*a* can be fitted to an internal terminal that is to be connected thereto. The internal terminal 2*a* is formed by using a plate composed of metal such as copper or a copper alloy. Plating such as Ni plating and Au plating may be performed on a surface.

In the case where the surface mount connector 10*a* is mounted on the substrate, the internal terminal 2*a* of the surface mount connector 10*a* does not extend below the external terminal 4*a*. For this reason, an electrode that is connected to an internal terminal can be located inside the tubular portion of the external terminal 4*a*. Thus, the external terminal 4*a* and the internal terminal 2*a* are unlikely to have capacitance, the external terminal 4*a* and the electrode are unlikely to have capacitance, and impedance mismatching is reduced. In the case where the substrate is a multilayer substrate that has a conductive layer between ground layers, the electrode of the substrate can be directly connected to the internal terminal from the conductive layer and is not exposed to the outside from the surface mount connector 10*a*. Accordingly, an influence of a noise from the outside can be avoided.

Second Embodiment

Figure 2A:
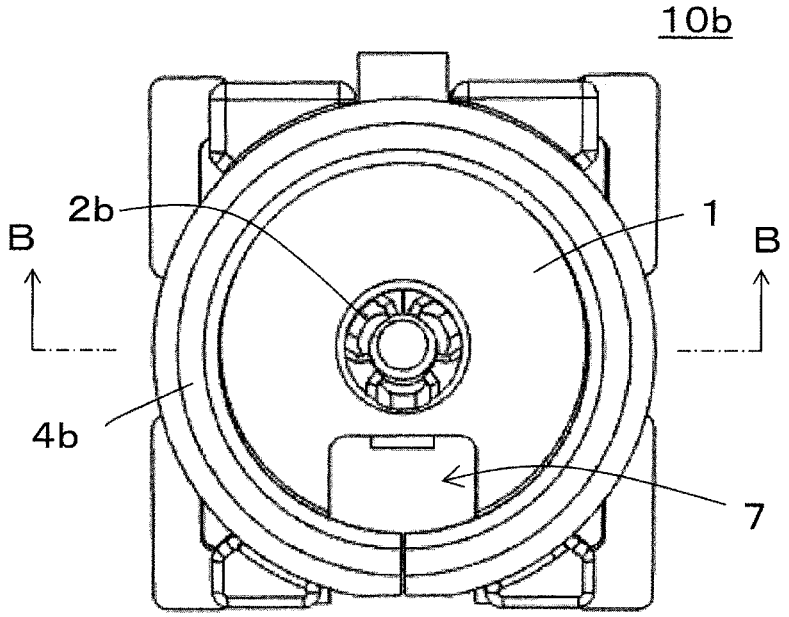
FIG. 2A is a plan view of a surface mount connector according to a second embodiment.
Figure 2B:
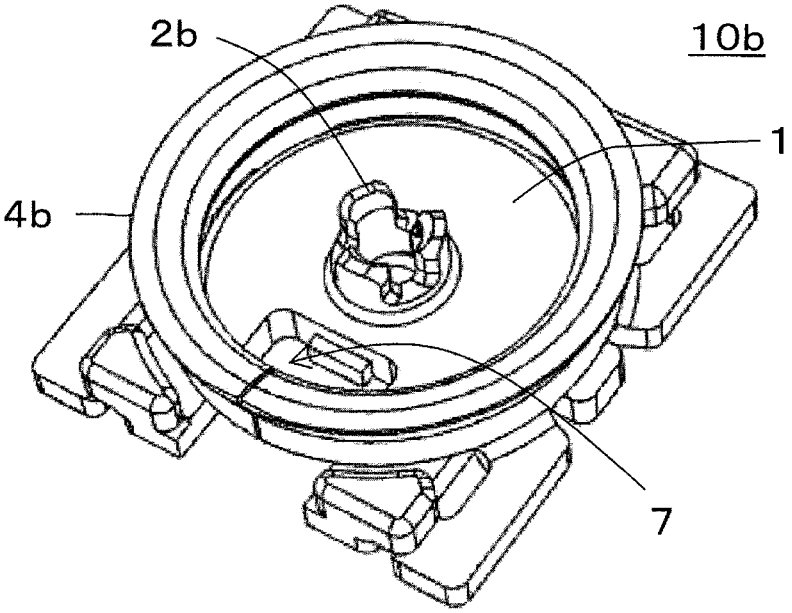
FIG. 2B is a perspective view of the surface mount connector according to the second embodiment.
Figure 2C:
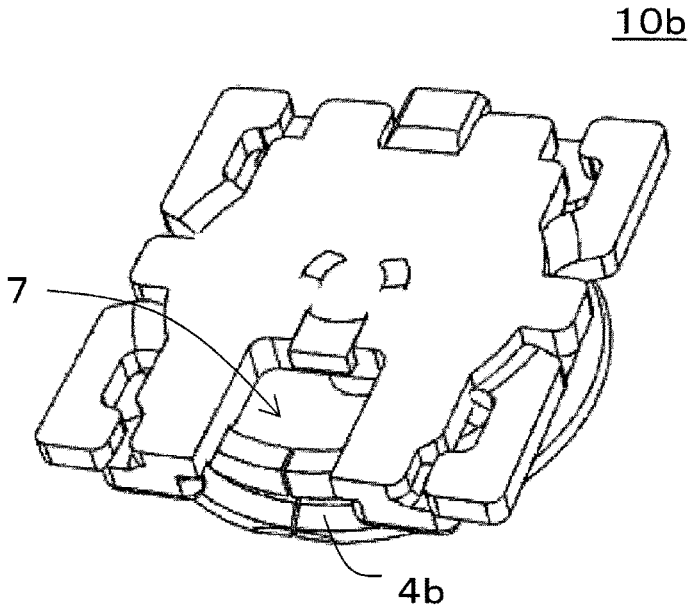
FIG. 2C is a perspective back view of the surface mount connector according to the second embodiment.
Figure 2D:
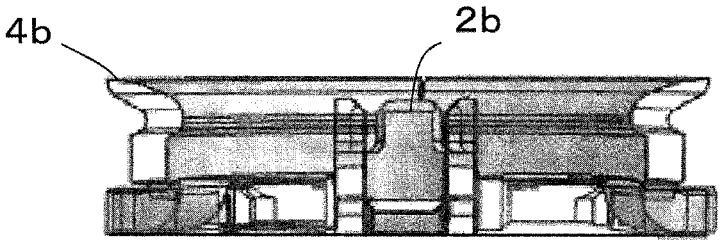
FIG. 2D is a sectional view of FIG. 2A taken along line B-B.

FIG. 2A is a plan view of a surface mount connector 10*b* according to a second embodiment. FIG. 2B is a perspective view of the surface mount connector 10*b* according to the second embodiment. FIG. 2C is a perspective back view of the surface mount connector according to the second embodiment. FIG. 2D is a sectional view of FIG. 2A taken along line B-B.

The surface mount connector 10*b* according to the second embodiment differs from the surface mount connector according to the first embodiment in that the surface mount connector is a plug receptacle (female type). Another difference is that an internal terminal 2*b* does not have a cylindrical shape but has a shape of three portions of an annular shape. Another difference is that a through-hole 7 extends not only inside an external terminal 4*b* but also outside the tubular portion of the external terminal 4 *b*.

The surface mount connector 10*b*, in which the internal terminal 2*b* does not extend to a location outside the external terminal 4*b*, inhibits the cutoff frequency from decreasing as in the surface mount connector according to the first embodiment. Adjustment in the size of the through-hole 7 that is formed in the insulator 1 inside the tubular portion of the external terminal 4*b* enables the characteristics impedance of the external terminal 4*b* and the internal terminal 2*b* to be adjusted and enables the electrical characteristics to be improved. The through-hole 7, which is an air layer and has a relative dielectric constant of 1, enables the cutoff frequency to be a frequency in a high frequency band, and a connector that has a decreased size and that supports a high frequency can be provided. In the case a space is formed as the through-hole 7, the flux that comes from the solder during mounting can be stored in the space.

Third Embodiment

Figure 3A:
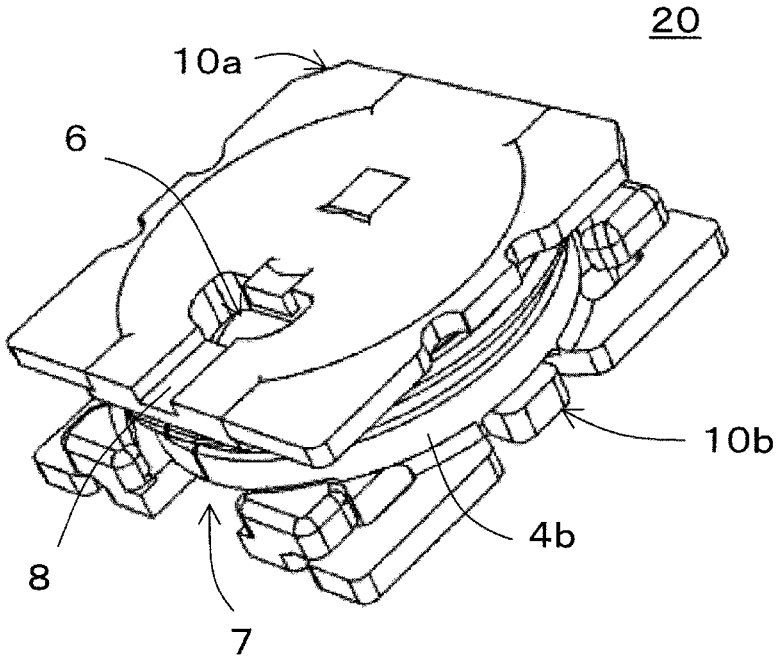
FIG. 3A is a perspective view of a surface mount connector set according to a third embodiment.
Figure 3B:
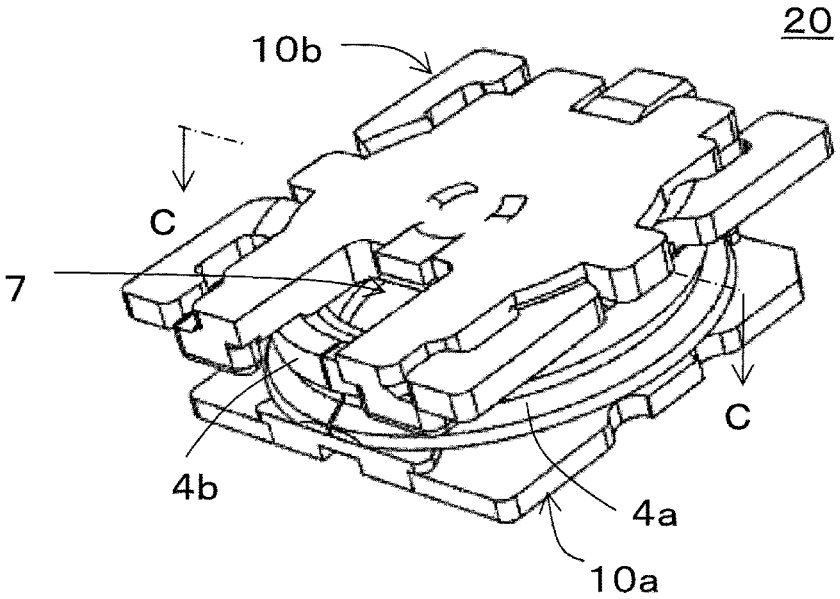
FIG. 3B is a perspective back view of the surface mount connector set according to the third embodiment.
Figure 3C:
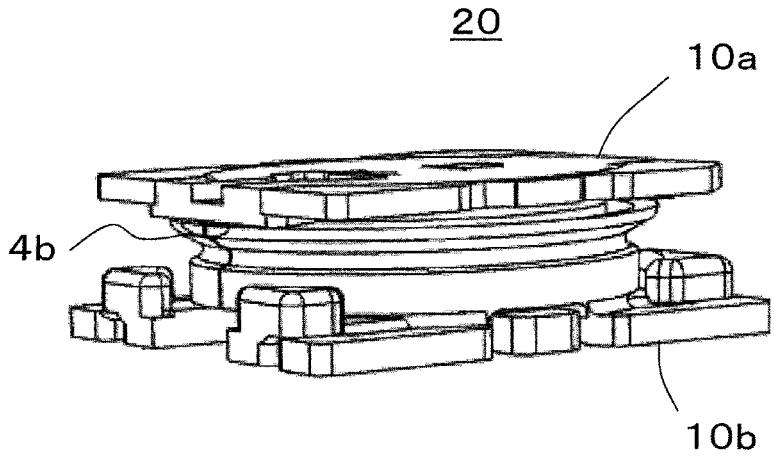
FIG. 3C is a perspective side view of the surface mount connector set according to the third embodiment.
Figure 3D:
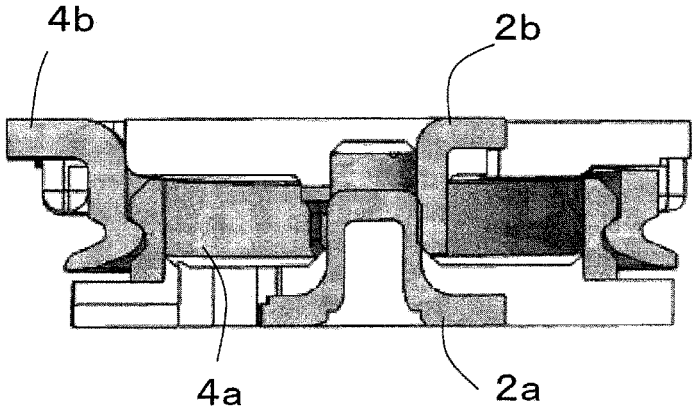
FIG. 3D is a sectional view of FIG. 3B taken along line C-C.

FIG. 3A is a perspective view of a surface mount connector set 20 according to a third embodiment. FIG. 3B is a perspective back view of the surface mount connector set 20 according to the third embodiment. FIG. 3C is a perspective side view of the surface mount connector set 20 according to the third embodiment. FIG. 3D is a sectional view of FIG. 3B taken along line C-C.

The surface mount connector set 20 according to the third embodiment is a surface mount connector set that is obtained by combining the surface mount connector (receptacle) according to the first embodiment and the surface mount connector (plug receptacle) according to the second embodiment. In the surface mount connector set 20, as illustrated in FIG. 3A to FIG. 3C, the external terminal 4*a* of the surface mount connector 10*a* that is the receptacle and the external terminal 4*b* of the surface mount connector 10*b* that is the plug receptacle are fitted to each other and electrically connected to each other. As illustrated in the sectional view in FIG. 3D, the internal terminal 2*a* of the surface mount connector 10*a* and the internal terminal 2*b* of the surface mount connector 10*b* are fitted to each other and electrically connected to each other.

Fourth Embodiment

Figure 4A:
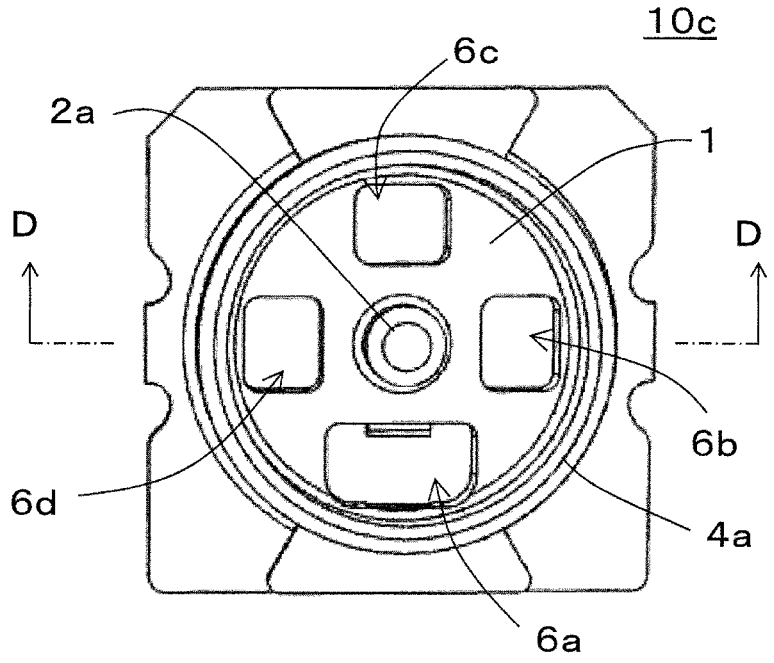
FIG. 4A is a plan view of a surface mount connector according to a fourth embodiment.
Figure 4B:
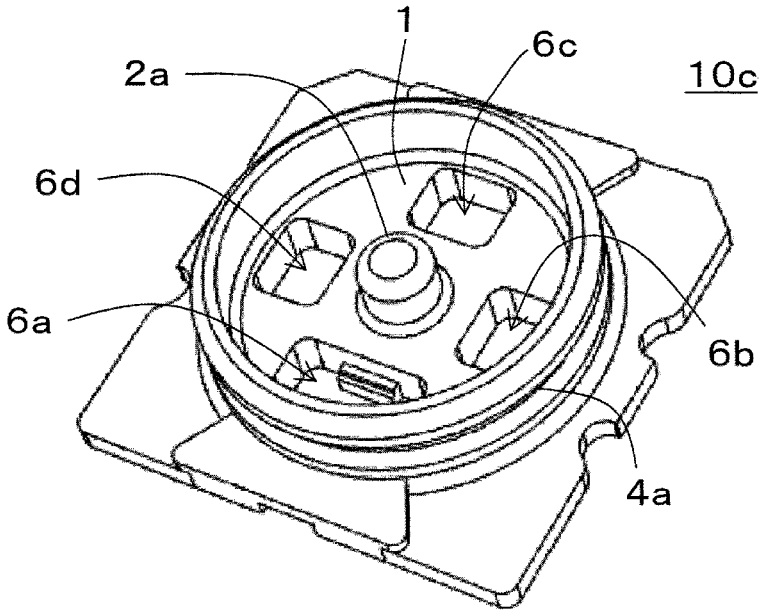
FIG. 4B is a perspective view of the surface mount connector according to the fourth embodiment.
Figure 4C:
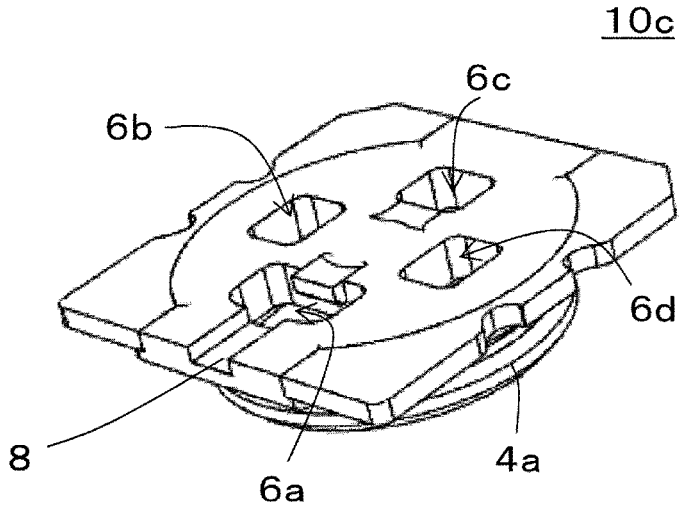
FIG. 4C is a perspective back view of the surface mount connector according to the fourth embodiment.
Figure 4D:
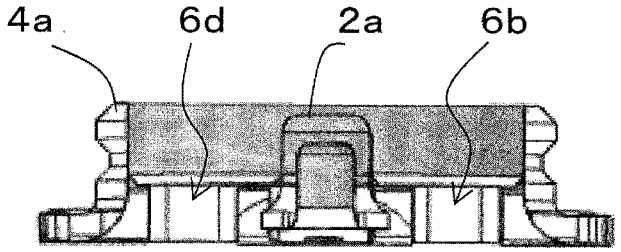
FIG. 4D is a sectional view of FIG. 4A taken along line D-D.

FIG. 4A is a plan view of a surface mount connector 10*c* according to a fourth embodiment. FIG. 4B is a perspective view of the surface mount connector 10*c* according to the fourth embodiment. FIG. 4C is a perspective back view of the surface mount connector 10*c* according to the fourth embodiment. FIG. 4D is a sectional view of FIG. 4A taken along line D-D.

The surface mount connector according to the fourth embodiment is a receptacle and differs from the surface mount connector according to the first embodiment in having four through-holes 6*a* to 6*d*. The number of the through-holes 6 is not limited to 1 or 4. In the case where the through-holes 6*a* to 6*d* are formed, the through-holes 6*a* to 6*d* are preferably symmetrical with respect to the internal terminal 2*a*. This enables a state of an electric field inside the external terminal 4*a* to be more uniformly controlled and improves the electrical characteristics.

Fifth Embodiment

Figure 5A:
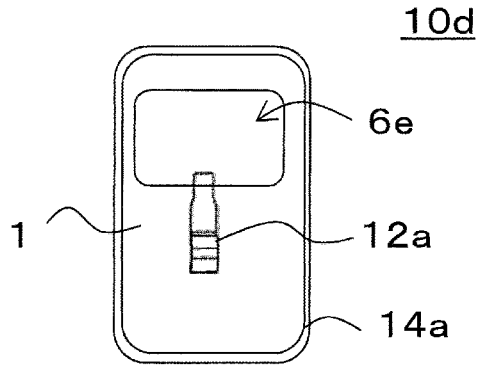
FIG. 5A is a plan view of a surface mount connector (receptacle) according to a fifth embodiment.
Figure 5B:
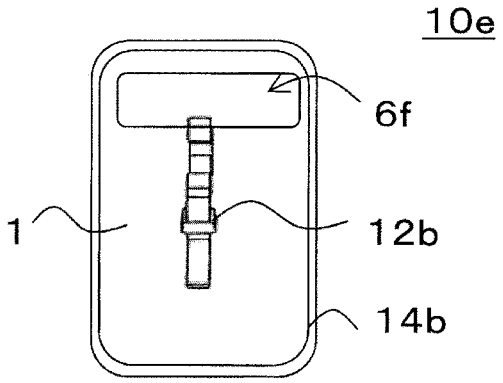
FIG. 5B is a plan view of a surface mount connector (plug receptacle) according to the fifth embodiment.
Figure 5C:
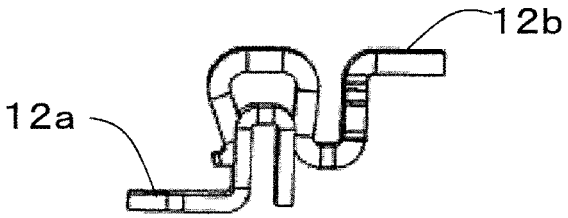
FIG. 5C schematically illustrates an internal terminal of the receptacle in FIG. 5A and an internal terminal of the plug receptacle in FIG. 5B that are joined to each other.

FIG. 5A is a plan view of a surface mount connector (receptacle) 10*d* according to the fifth embodiment. FIG. 5B is a plan view of a surface mount connector (plug receptacle) 10*e* according to the fifth embodiment. FIG. 5C schematically illustrates an internal terminal 12*a* of the receptacle 10*d* in FIG. 5A and an internal terminal 12*b* of the plug receptacle 10*e* in FIG. 5B that are joined to each other.

As illustrated in FIG. 5C, the surface mount connector (receptacle) 10*d* according to the fifth embodiment and the surface mount connector (plug receptacle) 10*e* differ from the surface mount connectors according to the first and second embodiments in that the internal terminals 12*a* and 12*b* are terminals having bend shapes. Another difference is that tubular portions of external terminals 14*a* and 14*b* do not have circular shapes but have rectangular shapes. The external terminals 14*a* and 14*b* surround the internal terminals 12*a* and 12*b*, respectively. The internal terminals 12*a* and 12*b* are not limited to a set. Multiple internal terminal sets may be provided. In the surface mount connector set that is obtained by combining the surface mount connector (receptacle) 10*d* and the surface mount connector (plug receptacle) 10*e*, the internal terminals 12*a* and 12*b* having the bend shapes engage each other and are electrically connected to each other. The external terminals 14*a* and 14*b* are fitted to each other and electrically connected to each other, although the shapes differ from those of the surface mount connector set according to the third embodiment. The external terminal 14*b* has a diameter larger than that of the external terminal 14*a*. In the case where the external terminals are not circular, an external terminal having a diameter larger than that of the other external terminal is defined as an external terminal that surrounds an area larger than an area that is surrounded by the other external terminal. In an example described above, both of the surface mount connector 10*d* and the surface mount connector 10*e* have the through-holes but are not limited thereto. For example, either the surface mount connector 10*d* or the surface mount connector 10*e* may has the through-hole. Also in the case where either of them has the through-hole, the factor in the electric field disturbance can be less than that in the case where both of them have no through-holes, and the electrical characteristics can be improved.

The present disclosure includes embodiments that are obtained by appropriately combining freely selected embodiments and/or examples among the embodiments and/or examples described above. The effects of the embodiments and/or examples can be achieved.

A surface mount connector according to the present disclosure, in which an internal terminal does not extend to a location outside an external terminal, inhibits the cutoff frequency from decreasing. In addition, adjustment in the size of a through-hole that is formed inside the external terminal enables the characteristics impedance of the external terminal and the internal terminal to be adjusted and enables electrical characteristics to be improved. For this reason, a surface mount connector that has excellent electrical characteristics can be provided.

What is claimed is:

1. A connector comprising:

an external terminal that includes a tubular portion that extends in a first direction;

an internal terminal that is separated from the external terminal inside the tubular portion when viewed in the first direction; and an insulator that is disposed between the internal terminal and the external terminal and that has a first main surface and a second main surface opposite the first main surface, a portion of the insulator inside the tubular portion has at least one through-hole that extends from the first main surface to the second main surface, and the insulator has a groove that is on the second main surface and that extends from the through-hole to a location outside the tubular portion when viewed in the first direction.

2. The connector according to claim 1, wherein an entire circumference of the through-hole is surrounded by the insulator when viewed in the first direction.

3. The connector according to claim 1, wherein the insulator has a plurality of the through-holes inside the tubular portion.

4. The connector according to claim 1, wherein the groove extends from the first main surface to the second main surface.

5. A connector set comprising:

a first connector that includes a first external terminal and a first internal terminal; and a second connector that includes a second external terminal that engages the first external terminal and a second internal terminal that engages the first internal terminal;

wherein the first connector includes the first external terminal that includes a tubular portion that extends in a first direction, the first internal terminal that is separated from the first external terminal inside the tubular portion when viewed in the first direction, and a first insulator that is disposed between the first internal terminal and the first external terminal and that has a first main surface and a second main surface opposite the first main surface, wherein the second connector includes the second external terminal that includes a tubular portion that extends in the first direction and that has a diameter larger than that of the first external terminal, the second internal terminal that is separated from the second external terminal inside the tubular portion when viewed in the first direction, and a second insulator that is disposed between the second internal terminal and the second external terminal and that has a first main surface and a second main surface opposite the first main surface, wherein a portion of the first insulator or a portion of the second insulator inside the tubular portion, or each of the portion of the first insulator and the portion of the second insulator, has a through-hole that extends from the first main surface to the second main surface, and wherein the insulator that has the through-hole has a groove that is on the second main surface and that extends from the through-hole to a location outside the tubular portion when viewed in the first direction.

6. The connector set according to claim 5, wherein the internal terminal has a portion that extends in the first direction and a portion that extends toward the external terminal from the portion to the end when viewed in the first direction, and wherein the portion that extends toward the external terminal overlaps the insulator when viewed in the first direction.

7. The connector set according to claim 5, wherein the first insulator has the through-hole, and an entire circumference of the through-hole is surrounded by the first insulator when viewed in the first direction.

8. The connector set according to claim 5, wherein the second insulator has the through-hole, and an entire circumference of the through-hole is surrounded by the second insulator when viewed in the first direction.

9. The connector set according to claim 6, wherein each of the first and second insulators inside the tubular portion has the through-hole that extends from the first main surface to the second main surface.

* * * * *